US009852686B2

(12) United States Patent
So et al.

(10) Patent No.: US 9,852,686 B2
(45) Date of Patent: Dec. 26, 2017

(54) DISPLAY DEVICE INCLUDING REPAIRED DEFECTIVE PIXELS

(71) Applicant: Samsung Display Co., Ltd., Yongin, Gyeonggi-Do (KR)

(72) Inventors: Dong Yoon So, Asan-si (KR); Tae Gon Kim, Cheonan-si (KR); Kyong tae Park, Suwon-si (KR); Sung Ho Cho, Seoul (KR); Yu Hyun Cho, Seoul (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 87 days.

(21) Appl. No.: 14/699,616

(22) Filed: Apr. 29, 2015

(65) Prior Publication Data

US 2016/0189644 A1 Jun. 30, 2016

(30) Foreign Application Priority Data

Dec. 29, 2014 (KR) ..... 10-2014-0192011

(51) Int. Cl.
*G09G 5/00* (2006.01)
*G09G 3/3233* (2016.01)

(52) U.S. Cl.
CPC ... *G09G 3/3233* (2013.01); *G09G 2300/0413* (2013.01); *G09G 2300/0426* (2013.01); *G09G 2330/08* (2013.01); *G09G 2330/10* (2013.01); *G09G 2330/12* (2013.01)

(58) Field of Classification Search
CPC ..... G09G 3/3233; G09G 2300/0413; G09G 2330/08; G09G 2330/12; G09G 2330/10
USPC ..... 345/205
See application file for complete search history.

(56) References Cited

U.S. PATENT DOCUMENTS 8,330,691 B2 * 12/2012 Tanimoto ..... G02F 1/136286 345/92
9,129,923 B1 * 9/2015 Han ..... H01L 27/3248
2008/0179592 A1 * 7/2008 Na ..... G02F 1/13458 257/48
2013/0141314 A1 * 6/2013 Ka ..... G09G 3/006 345/55

(Continued)

FOREIGN PATENT DOCUMENTS

JP 2007-316511 A 12/2007
KR 100666639 B1 * 1/2007 ..... G09G 3/30

(Continued)

*Primary Examiner* — Yuzhen Shen
(74) *Attorney, Agent, or Firm* — Knobbe, Martens, Olson & Bear, LLP

(57) ABSTRACT

A display device is disclosed. In one aspect, the display device includes a display panel including a display area and a non-display area surrounding the display area. The display device also includes a plurality of active pixels formed in the display area extending in first and second directions as a matrix, a plurality of dummy pixels formed in the non-display area and extending in the second direction, a repair test line and one or more active pixel test lines formed in the non-display area and extending in the first direction, a plurality of scan lines electrically connected to the active pixels and the dummy pixels and extending in the first direction, a plurality of data lines electrically connected to the active pixels and extending in the second direction, and at least one dummy data line electrically connected to the dummy pixels and extending in the second direction.

20 Claims, 9 Drawing Sheets

(56) References Cited

U.S. PATENT DOCUMENTS

| | | | | |
|---|---|---|---|---|
| 2015/0102312 | A1* | 4/2015 | Lee | G09G 3/3233<br>257/40 |
| 2016/0163243 | A1* | 6/2016 | Park | G09G 3/3258<br>345/205 |

FOREIGN PATENT DOCUMENTS

| | | | |
|---|---|---|---|
| KR | 10-2008-0024009 | A | 3/2008 |
| KR | 10-2011-0080387 | A | 7/2011 |
| KR | 10-2014-0035724 | A | 3/2014 |
| KR | 10-2015-0033152 | A | 4/2015 |
| KR | 10-2015-0033153 | A | 4/2015 |
| KR | 10-2015-0042355 | A | 4/2015 |
| KR | 10-2015-0042602 | A | 4/2015 |

* cited by examiner

FIG. 4

| TEST IMAGE | WHITE | BLACK | REPAIRED PIXELS |
|---|---|---|---|
| INPUT DATA | DC_Repair : Green<br>DC_R : on<br>DC_G : on<br>DC_B : on | DC_Repair : off<br>DC_R : off<br>DC_G : off<br>DC_B : off | DC_Repair : Green<br>DC_R : off<br>DC_G : off<br>DC_B : off |
| STATE | WHIGHT IMAGE DISPLAYED | BLACK IMAGE DISPLAYED | REPAIRED PIXELS DISPLAYED AS G DOTS |
| TEST TARGET | DEFECTIVE PIXELS DISPLAYED AS DARK SPOT | DEFECTIVE PIXELS DISPLAYED AS BRIGHT SPOT | IDENTIFY LOCATIONS OF REPAIRED PIXELS |

FIG. 5

| TEST IMAGE | WHITE | BLACK | REPAIRED PIXELS |
|---|---|---|---|
| INPUT DATA | DC_Repair : off<br>DC_R : on<br>DC_G : off<br>DC_B : off | DC_Repair : Green<br>DC_R : off<br>DC_G : on<br>DC_B : off | DC_Repair : off<br>DC_R : off<br>DC_G : off<br>DC_B : on |
| STATE | R IMAGE DISPLAYED | G IMAGE DISPLAYED | B IMAGE DISPLAYED |
| STATE OF REPAIRED PIXELS | REPAIRED R PIXELS : off<br>REPAIRED G PIXELS : off<br>REPAIRED B PIXELS : off | REPAIRED R PIXELS : on<br>REPAIRED G PIXELS : on<br>REPAIRED B PIXELS : on | REPAIRED R PIXELS : off<br>REPAIRED G PIXELS : off<br>REPAIRED B PIXELS : off |
| REMARKS | REPAIRED R PIXELS DETECTED AS DARK SPOTS | REPAIRED R AND B PIXELS DETECTED AS BRIGHT SPOTS | REPAIRED B PIXELS DETECTED AS DARK SPOTS |

FIG. 6

| TEST IMAGE | RED | GREEN | BLUE |
|---|---|---|---|
| INPUT DATA | DC_Repair : off<br>DC_R : on<br>DC_G : off<br>DC_B : off | DC_Repair : off<br>DC_R : off<br>DC_G : on<br>DC_B : off | DC_Repair : off<br>DC_R : off<br>DC_G : off<br>DC_B : on |
| STATE | R IMAGE DISPLAYED | G IMAGE DISPLAYED | B IMAGE DISPLAYED |
| STATE OF REPAIRED PIXELS | ALL REPAIRED PIXELS : off | ALL REPAIRED PIXELS : off | ALL REPAIRED PIXELS : off |
| REMARKS | REPAIRED R PIXELS DETECTED AS DARK SPOTS | REPAIRED G PIXELS DETECTED AS DARK SPOTS | REPAIRED B PIXELS DETECTED AS DARK SPOTS |

FIG. 9

| TEST IMAGE | RED | GREEN | BLUE |
|---|---|---|---|
| INPUT DATA | DC_R : on<br>DC_G : off<br>DC_B : off<br>DC_Repair$_1$ : off<br>DC_Repair$_2$ : on | DC_R : off<br>DC_G : on<br>DC_B : off<br>DC_Repair$_1$ : on<br>DC_Repair$_2$ : off | DC_R : off<br>DC_G : off<br>DC_B : on<br>DC_Repair$_1$ : off<br>DC_Repair$_2$ : off |
| STATE | R IMAGE DISPLAYED | G IMAGE DISPLAYED | B IMAGE DISPLAYED |
| STATE OF REPAIRED PIXELS | REPAIRED R PIXELS : on<br>REPAIRED G PIXELS : off<br>REPAIRED B PIXELS : off | REPAIRED R PIXELS : off<br>REPAIRED G PIXELS : on<br>REPAIRED B PIXELS : off | REPAIRED R PIXELS : off<br>REPAIRED G PIXELS : off<br>REPAIRED B PIXELS : on |
| REMARKS | R IMAGE DISPLAYED WITH NO DARK SPOTS AS LONG AS THERE ARE NO OTHER DEFECTIVE PIXELS | G IMAGE DISPLAYED WITH NO DARK SPOTS AS LONG AS THERE ARE NO OTHER DEFECTIVE PIXELS | B IMAGE DISPLAYED WITH NO DARK SPOTS AS LONG AS THERE ARE NO OTHER DEFECTIVE PIXELS |

DISPLAY DEVICE INCLUDING REPAIRED DEFECTIVE PIXELS

INCORPORATION BY REFERENCE TO ANY PRIORITY APPLICATIONS

This application claims priority to Korean Patent Application No. 10-2014-0192011 filed on Dec. 29, 2014 in the Korean Intellectual Property Office, the disclosure of which is incorporated herein by reference in its entirety.

BACKGROUND

Field

The described technology generally relates to a display device.

Description of the Related Technology

There is increasing demand for lighter and thinner monitors, televisions (TVs) and portable displays, such that cathode ray tube (CRT) displays continue to be replaced with flat-panel displays such as liquid crystal displays (LCDs) or organic electroluminescent (EL) displays.

A flat-panel display includes a plurality of pixels, which display an image. Pixels receive data signals corresponding to an image to be displayed and display a plurality of dots of a gray level corresponding to the image.

SUMMARY OF CERTAIN INVENTIVE ASPECTS

One inventive aspect relates a display device that can provide an improved display quality by repairing defective pixels with dummy pixels.

Another aspect is a display device that can allow any defect therein to be easily detected after the repair of defective pixels with dummy pixels.

Another aspect is a display device including: a display panel having a display area, in which an image is displayed, and a non-display area, which surrounds the display area; a plurality of active pixels are arranged in the display area along first and second directions; a plurality of dummy pixels arranged in the non-display area along the second direction; a repair test line and one or more active pixel test lines arranged in the non-display area and extending in the first direction; a plurality of scan lines connectable to the active pixels and extending in the first direction; a plurality of data lines connectable to the active pixels and the dummy pixels and extending in the second direction; at least one dummy data line connected to or connectable to the dummy pixels and extending in the second direction; a plurality of repair lines connected to the dummy pixels and extending in the first direction, wherein at least one of the repair lines connects at least one of the dummy pixels and at least one of the active pixels; and a plurality of switching elements connecting the dummy data line and the repair test lines and connecting each of the data lines to one of the active pixel test lines.

Another aspect is a display device comprising: a display panel including a display area, in which an image is displayed, and a non-display area, which surrounds the display area, a plurality of active pixels are arranged in the display area along first and second directions, a plurality of dummy pixels arranged in the non-display area along the second direction, a plurality of active pixel test lines arranged in the non-display area and extending in the first and second directions.

Another aspect is a display device, comprising: a display panel including a display area configured to display an image and a non-display area surrounding the display area; a plurality of active pixels formed in the display area extending in first and second directions as a matrix; a plurality of dummy pixels formed in the non-display area and extending in the second direction; a repair test line and one or more active pixel test lines formed in the non-display area and extending in the first direction; a plurality of scan lines electrically connected to the active pixels and the dummy pixels and extending in the first direction; a plurality of data lines electrically connected to the active pixels and extending in the second direction; at least one dummy data line electrically connected to the dummy pixels and extending in the second direction; a plurality of repair lines electrically connected to the dummy pixels and extending in the first direction, wherein at least one of the dummy pixels is electrically connected to at least one of the active pixels via at least one of the repair lines; and a plurality of switching elements including a plurality of first switching elements configured to electrically connect the dummy data line to the repair test lines and a plurality of second switching elements configured to electrically connect each of the data lines to one of the active pixel test lines.

The above display device further comprises a gate test line formed in the non-display area and extending in the first direction, wherein the gate test line is electrically connected to the switching elements, wherein the switching elements are configured to switch on or off based on a voltage signal applied to the gate test line.

In the above display device, the switching elements include P-channel metal oxide semiconductor (PMOS) transistors, wherein each of the switching elements includes a gate terminal electrically connected to the test gate line, a drain terminal electrically connected to the dummy data line or one of the data lines, and a source terminal electrically connected to the repair test line or one of the active pixel test lines.

In the above display device, the active pixel repair test lines include red (R), green (G) and blue (B) test lines.

In the above display device, each of the active pixels includes a pixel circuit electrically connected to one of the data lines and a light-emitting element configured to receive a driving current from the pixel circuit, wherein the pixel circuit and the light-emitting element are electrically connected via a selectively cuttable line.

In the above display device, at least one of the active pixels includes i) at least one first repair portion configured to be cut so as to block a driving current applied from the pixel circuit to the light-emitting element and ii) at least one second repair portion configured to short the light-emitting element and the repair line and configured to transfer a driving current to the light-emitting element from the at least one of dummy pixels.

The above display device further comprises a data driver configured to i) respectively transmit a plurality of data signals to the data lines, ii) transmit a dummy data signal to the dummy data line, and iii) transmit at least one data signal to the at least one dummy pixel as the dummy data signal.

The above display device further comprises a plurality of pads configured to electrically connect one of the dummy data line and the data lines to the switching elements.

The above display device further comprises a data driver configured to respectively transmit a plurality of data signals to the data lines, and transmit a dummy data signal to the dummy data line, wherein the data driver is electrically connected to the dummy data line and the data lines via the pads.

In the above display device, the data driver is further configured to transmit at least one data signal to the at least one dummy pixel as the dummy data signal.

Another aspect is a display device, comprising: a display panel including a display area configured to display an image and a non-display area surrounding the display area; a plurality of active pixels formed in the display area extending in the first and second directions as a matrix; a plurality of dummy pixels formed in the non-display area and extending in the second direction; a plurality of active pixel test lines formed in the non-display area and extending in the first and second directions; a plurality of scan lines electrically connected to the active pixels and extending in the first direction; a plurality of data lines electrically connected to the active pixels and extending in the second direction; at least one dummy data line electrically connected to the dummy pixels and extending in the second direction; a plurality of repair lines electrically connected to the dummy pixels and extending in the first direction, wherein at least one of the dummy pixels is electrically connected to at least one of the active pixels via at least one of the repair lines; and a plurality of switching elements including a plurality of first switching elements configured to electrically connect at least one of the dummy pixels to one of the active pixel test lines and a plurality of second switching elements configured to electrically connect each of the data lines to one of the active pixel test lines.

The above display device further comprises a gate test line formed in the non-display area and extending in the first and second directions, wherein the gate test line is electrically connected to the switching elements, and wherein the switching elements are configured to switch on or off based on a voltage signal applied to the gate test line.

In the above display device, the switching elements include PMOS transistors, and wherein each of the switching elements includes a gate terminal electrically connected to the test gate line, a drain terminal electrically connected to the dummy data line or one of the data lines, and a source terminal electrically connected to the repair test line or one of the active pixel test lines.

In the above display device, the active pixel repair test lines include R, G and B test lines.

In the above display device, each of the active pixels includes a pixel circuit electrically connected to one of the data lines and a light-emitting element configured to receive a driving current from the pixel circuit, wherein the pixel circuit and the light-emitting element are electrically connected via a selectively cuttable line.

In the above display device, at least one of the active pixels includes i) at least one first repair portion configured to be cut so as to block a driving current applied from the pixel circuit to the light-emitting element and ii) at least one second repair portion configured to short the light-emitting element and the repair line and configured to ransfer a driving current to the light-emitting element from the at least one of dummy pixels.

The above display device further comprises a data driver configured to i) respectively transmit a plurality of data signals to the data lines, ii) transmit a dummy data signal to the dummy data line, and iii) transmit at least one data signal to the at least one dummy pixel as the dummy data signal.

The above display device further comprises a plurality of pads configured to electrically connect one of the dummy data line and the data lines to the switching elements.

The above display device further comprises a data driver configured to respectively transmit a plurality of data signals to the data lines, and transmit a dummy data signal to the dummy data line, wherein the data driver is electrically connected to the dummy data line and the data lines via the pads.

In the above display device, the data driver is further configured to transmit at least one data signal to the at least one dummy pixel as the dummy data signal.

According to at least one of the disclosed embodiments, even if there are defective pixels among the pixels of a display device, it is possible to improve the display quality of the display device by repairing the defective pixels with dummy pixels.

Also, it is possible to easily detect any defects in the display device after the repair of the defective pixels.

BRIEF DESCRIPTION OF THE DRAWINGS

FIG. 4 is a table for explaining an example of a method of identifying any bright and dark spots and locating any repaired pixels by applying the same test voltage to a repair test line and a green (G) test line.

FIG. 5 is a table for explaining an example of a method of identifying the display quality of any repaired pixels and other normal pixels by applying the same test voltage to the repair test line and the G test line.

FIG. 6 is a table for explaining an example of a method of identifying the display quality of repaired pixels and other normal pixels by applying an "off" voltage not only to the G test line, but also to the repair test line.

FIG. 9 is a table for explaining an example of a method of identifying the display quality of repaired pixels and other normal pixels by displaying R, G and B images on the display device according to the exemplary embodiment of FIG. 8.

DETAILED DESCRIPTION OF CERTAIN INVENTIVE EMBODIMENTS

Figure 1:
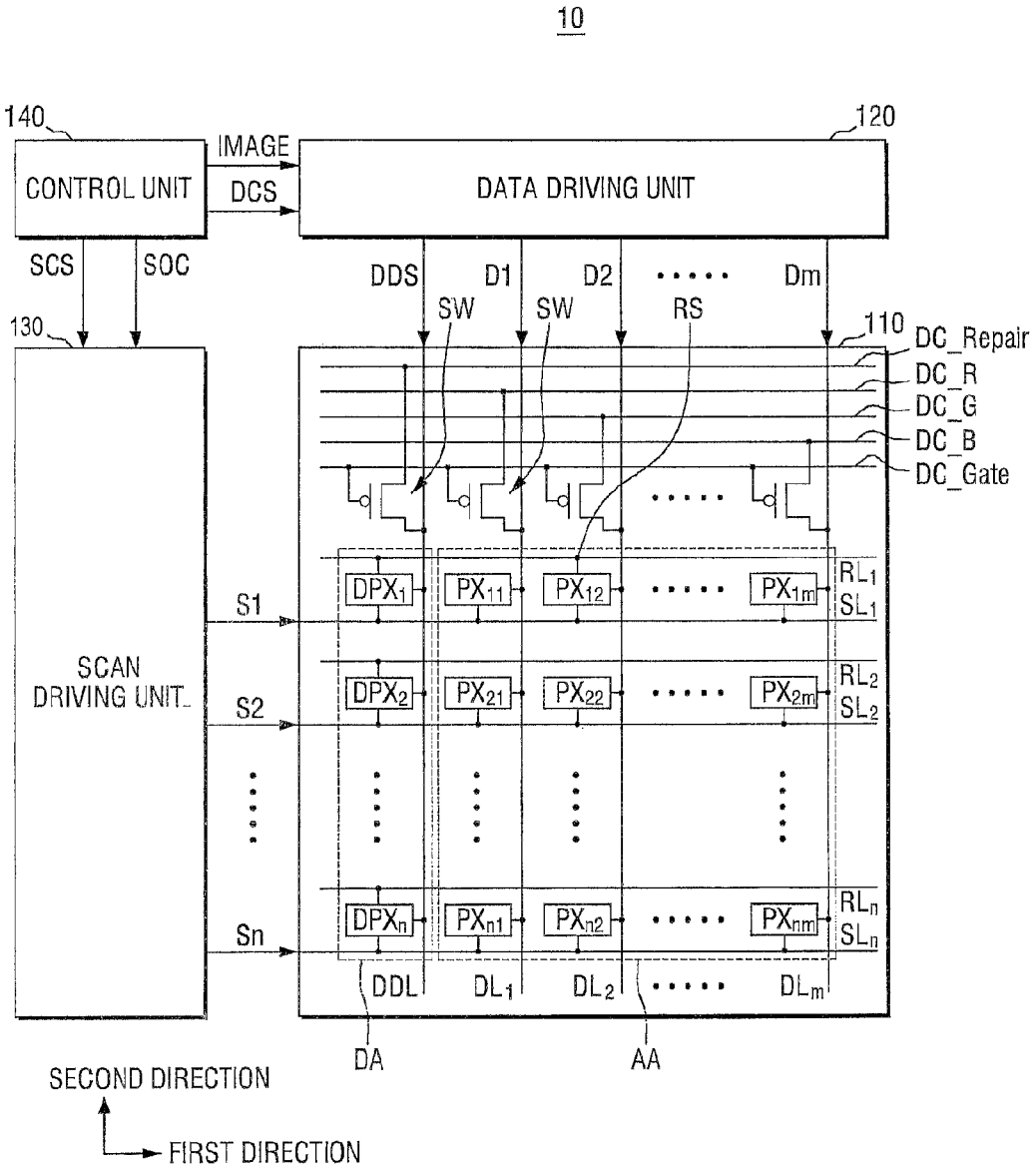
FIG. 1 is a schematic block diagram of a display device according to an exemplary embodiment.

When a defect occurs in a pixel, the pixel can either continuously emit light or emit no light regardless of the receipt of a scan signal and a data signal. Also, the pixel can emit light, but not at a gray level corresponding to the data signal. Defective pixels can be perceived to a viewer as bright spots or dark spots. Bright spots are highly visible and are thus easily noticeable to the viewer. Even though only some of the pixels are defective, the entire display device can appear to be defective. Accordingly, defective pixels can be the cause of low yield and high manufacturing cost.

Advantages and features of the described technology and methods of accomplishing the same can be understood more readily by reference to the following detailed description of preferred embodiments and the accompanying drawings. The described technology can, however, be embodied in many different forms and should not be construed as being limited to the embodiments set forth herein. Rather, these embodiments are provided so that this disclosure will be thorough and complete and will fully convey the concept of the invention to those skilled in the art, and the described technology will only be defined by the appended claims. Thus, in some embodiments, well-known structures and devices are not shown in order not to obscure the description of the invention with unnecessary detail. Like numbers refer to like elements throughout. In the drawings, the thickness of layers and regions are exaggerated for clarity.

It will be understood that when an element or layer is referred to as being "on," or "connected to" another element or layer, it can be directly on or connected to the other element or layer or intervening elements or layers can be present. In contrast, when an element is referred to as being "directly on" or "directly connected to" another element or layer, there are no intervening elements or layers present. As used herein, the term "and/or" includes any and all combinations of one or more of the associated listed items.

Spatially relative terms, such as "below," "beneath," "lower," "above," "upper," and the like, can be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

Embodiments described herein will be described referring to plan views and/or cross-sectional views by way of ideal schematic views of the described technology. Accordingly, the exemplary views can be modified depending on manufacturing technologies and/or tolerances. Therefore, the embodiments of the described technology are not limited to those shown in the views, but include modifications in configuration formed on the basis of manufacturing processes. Therefore, regions exemplified in figures have schematic properties and shapes of regions shown in figures exemplify specific shapes of regions of elements and not limit aspects of the described technology.

Hereinafter, embodiments of the described technology will be described with reference to the attached drawings. In this disclosure, the term "substantially" includes the meanings of completely, almost completely or to any significant degree under some applications and in accordance with those skilled in the art. Moreover, "formed on" can also mean "formed over." The term "connected" can include an electrical connection.

FIG. 1 is a schematic block diagram of a display device according to an exemplary embodiment.

Referring to FIG. 1, a display device 10 includes a display panel 110, a data driving unit or data driver 120, a scan driving unit or scan drive r130 and a control unit or timing control unit or timing controller 140.

The display panel 110 can include a display area and a non-display area. A portion of the display panel 110 where an image is to be displayed can be defined as the display area, and the rest of the display panel 110 can be defined as the non-display area.

An active area AA in which a plurality of active pixels $PX_{11}$ through $PX_{nm}$ are arranged and a dummy area DA in which a plurality of dummy pixels $DPX_1$ through $DPX_n$ are arranged can be defined in the display area of the display panel 110. For example, the dummy area DA is formed near the active area AA, and is provided on the left or right side of the active area AA. However, the described technology is not limited to this example. That is, alternatively, the dummy area DA can be provided on both the left and right sides of the active area AA, or at the top and/or bottom of the active area AA.

A plurality of scan lines $SL_1$ through $SL_n$, a plurality of data lines $DL_1$ through $DL_m$, and the active pixels $PX_{11}$ through $PX_{nm}$ can be provided in the active area AA. The scan lines $SL_1$ through $SL_n$, which extend in a first direction (for example, a horizontal direction) can transmit a plurality of scan signals S1 through Sn to the active pixels $PX_{11}$ through $PX_{nm}$. The data lines $DL_1$ through $DL_m$, which extend in a second direction crossing the first direction (for example, a vertical direction) can transmit a plurality of data signals D1 through Dm to the active pixels $PX_{11}$ through $PX_{nm}$ in response to the scan signals S1 through Sn. The active pixels $PX_{11}$ through $PX_{nm}$ are arranged in both the first and second directions along the scan lines $SL_1$ through $SL_n$ and the data lines $DL_1$ through $DL_m$.

Even though not specifically illustrated, the active pixels $PX_{11}$ through $PX_{nm}$ can be "detachably" connected to the data lines $DL_1$ through $DL_m$. The active pixels $PX_{11}$ through $PX_{nm}$ can be "detachably" connected to the scan lines $SL_1$ through $SL_n$.

The display panel 110 can also include a plurality of repair lines $RL_1$ through $RL_n$. The repair lines $RL_1$ through $RL_n$ can be connected to the dummy pixels $DPX_1$ through $DPX_n$, respectively, and can be arranged to be connectable to the active pixels $PX_{11}$ through $PX_{nm}$.

In the dummy area DA, the dummy pixels $DPX_1$ through $DPX_n$, which are connected to the scan lines $SL_1$ through $SL_n$, respectively, and to a dummy data line DDL that extends in the second direction, can be arranged along the second direction, but the described technology is not limited thereto. That is, alternatively, a plurality of columns of dummy pixels can be provided, and can be arranged along the second direction.

The term "unit pixel", as used herein, can indicate a single dot displaying a single natural color, and the term "active pixel", as used herein, can indicate one of two or more sub-pixels of a unit pixel that displays a color. However, the described technology is not limited to these definitions. That is, the term "active pixel" can indicate a unit pixel including a plurality of sub-pixels. Accordingly, when a single active pixel is described as being arranged or being connected to another member, it could be interpreted that one sub-pixel or a plurality of sub-pixels of a single unit pixel are arranged or are connected to another member, and this interpretation directly applies to dummy pixels. For example, when a single dummy pixel is described as being arranged or being connected to another member, it could be interpreted that one dummy pixel circuit or a number of dummy pixel circuits corresponding to the number of sub-pixels of each unit pixel are arranged or are connected to another member. When a single dummy pixel means a plurality of dummy pixel circuits, it should be interpreted that the dummy data line DDL includes a plurality of sub-dummy data lines connected to the plurality of dummy pixel circuits, respectively.

The term "connectable" or "connectably", as used herein, can indicate a state where two members are connectable via, for example, laser, during a repair process.

For example, when first and second members are described as being "connectably" arranged, it means that the first and second members are currently not connected to each other, but are in such a "connectable" state that they can be connected during a repair process. From a structural point of view, first and second members that are "connectable" can be arranged to intersect each other with an insulating layer provided in an area of overlap therebetween. In response to laser light being applied to the area of overlap between the first and second members, the insulating layer in the area of overlap between the first and second members can be destroyed, and the first and second members can become electrically connected.

The term "detachable" or "detachably", as used herein, can indicate a state where two members are detachable from each other by, for example, laser, during a repair process. For example, when first and second members are "detachably" arranged, it means that the first and second members are currently connected to each other, but are in such a "detachable" state that they can be disconnected during a repair process. From a structural point of view, first and second members that are "detachably" connected can be arranged to be connected to each other via a conductive connecting member. In response to a laser being applied to the conductive connecting member during a repair process, the conductive connecting member can be melted and cut, and as a result, the first and second members can become electrically insulated from each other. For example, the conductive connecting member includes a silicon layer, which can be melted by laser. In some embodiments, the conductive connecting member is melted and cut by Joule heat generated by a current.

In the non-display area of the display panel 110, a repair test line DC_Repair, a plurality of active pixel test lines (DC_R, DC_G and DC_B) and a test gate line DC_Gate can be arranged side-by-side along the first direction.

Figure 2:
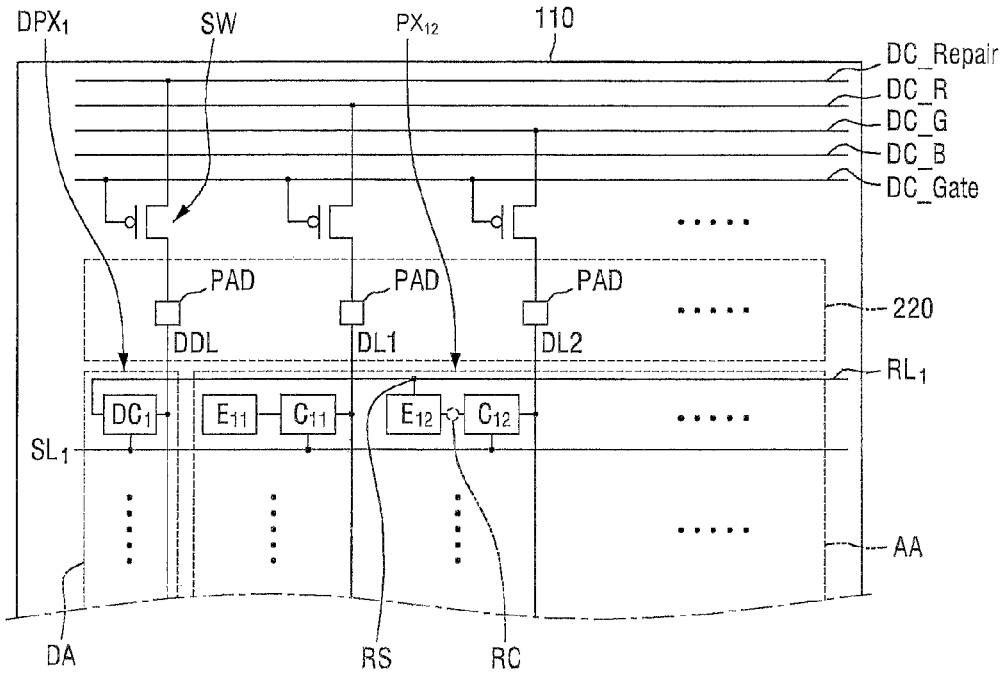
FIG. 2 is a detailed block diagram of a display panel illustrated in FIG. 1.
Figure 3:
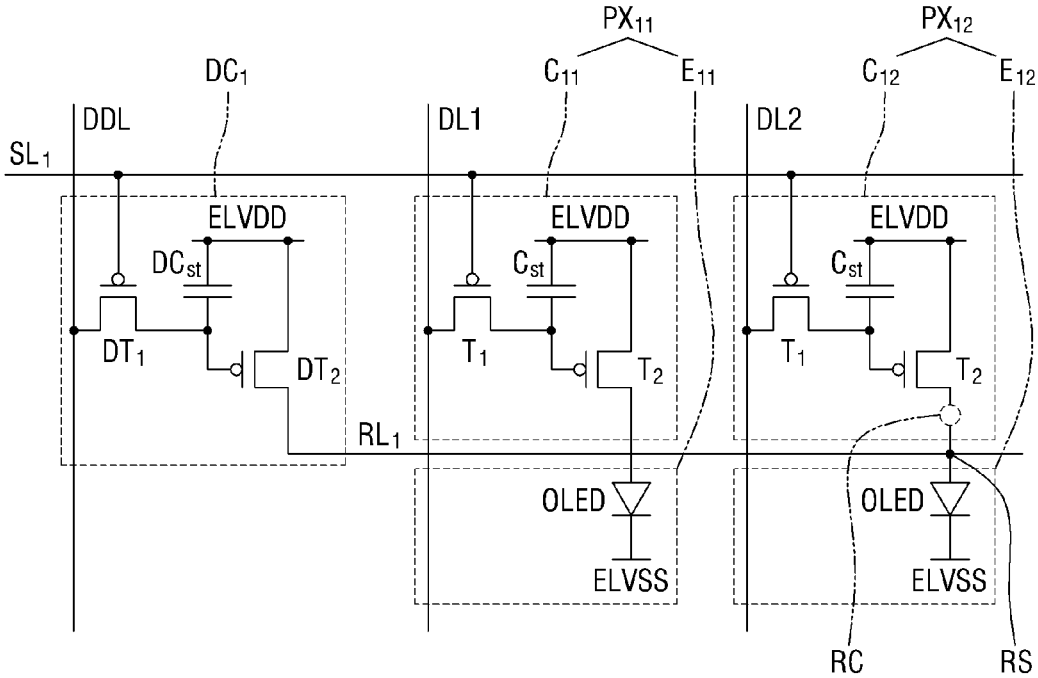
FIG. 3 is a circuit diagram illustrating pixel circuits and light-emitting elements illustrated in FIG. 2.

In the exemplary embodiment of FIGS. 1 to 3, the active pixels $PX_{11}$ through $PX_{nm}$ are arranged to form a red (R), green (G), blue (B) stripe pixel structure in which three active pixels displaying R, G and B colors, respectively, are sequentially arranged along each of the scan lines $SL_1$ through $SL_n$. Therefore, the active pixel test lines (DC_R, DC_G and DC_B) can include an R test line DC_R, a G test line DC_G and a B test line DC_B.

A plurality of switching devices SW can be arranged on the display panel 110. The switching devices SW can connect the dummy data line DDL and the repair test line DC_Repair, and can connect each of the data lines $DL_1$ through $DL_m$ to one of the R, G and B test lines DC_R, DC_G and DC_B.

The switching devices SW can be connected to the test gate line DC_Gate, and thus, the switching devices SW can be switched on or off according to a signal applied to the test gate line DC_Gate. For example, the switching devices SW are P-channel metal oxide semiconductor (PMOS) transistors, in which case, each of the switching devices SW has a gate terminal connected to the test gate line DC_Gate, a drain terminal connected to the dummy data line DDL or one of the data lines $DL_1$ through $DL_m$, and a source terminal connected to one of the repair test line DC_Repair and the R, G and B test lines DC_R, DC_G and DC_B. However, the described technology is not limited to this example. That is, the switching devices SW can also be implemented as N-channel metal oxide semiconductor (NMOS) transistors, bipolar junction transistors (BJTs) or complementary metal oxide semiconductor (CMOS) transistors.

The display panel 110 can be a flat panel display panel, such as an organic light-emitting diode (OLED) display panel, a thin-film transistor (TFT)-liquid crystal display (LCD) panel, a plasma display panel (PDP) or a light-emitting diode (LED) display panel, but the described technology is not limited thereto.

The data driving unit 120 can receive an image signal IMAGE and a data control signal DCS from the timing control unit 140, and can apply the received signals to the data lines $DL_1$ through $DL_m$. The data driving unit 120 can include a latch circuit (not illustrated) and a level shifter circuit (not illustrated). The latch circuit can store image data, which is input in series to the data driving unit 120, to output the image data to the display panel 110 substantially in parallel, and the level shifter circuit can adjust the level of an actual voltage provided to the display panel 110 according to the image signal IMAGE. The latch circuit and the level shifter circuit are already well known in the field to which the described technology pertains, and thus, detailed descriptions thereof will be omitted.

The scan driving unit 130 can receive a scan control signal SCS from the timing control unit 140, and can sequentially apply the scan signals S1 through Sn to the scan lines $SL_1$ through $SL_n$, respectively. The scan signals S1 through Sn can perform switching such that a dummy data signal applied via the dummy data line DDL and the data signals D1 through Dm applied via the data lines $DL_1$ through $DL_m$, respectively, can be applied to the dummy pixels $DPX_1$ through $DPX_n$ and the active pixels $PX_{11}$ through $PX_{nm}$.

The data driving unit 120, the scan driving unit 130 and the display panel 110 are illustrated in FIG. 1 as being separate functional blocks, but the described technology is not limited thereto. That is, the data driving unit 120 and the scan driving unit 130 can be implemented as IC chips mounted on the display panel 110 or as driving circuits directly formed on the display panel 110.

The control unit 140 can output the data control signal DCS, which is for driving the data driving unit 120, and the scan control signal SCS and a scan driving signal SOC, which are for driving the scan driving unit 130, in synchronization with the image signal IMAGE. The image signal IMAGE can be a signal regarding the gray level of each of the active pixels $PX_{11}$ through $PX_{nm}$ for displaying image data received from an external source (not illustrated) according to the arrangement of the active pixels $PX_{11}$ through $PX_{nm}$. The control unit 140 can process a raw image signal received from the external source into the image signal IMAGE by modulating or compensating for the raw image signal according to a user's preferences or the properties of the display device 10.

FIG. 2 is a detailed block diagram of the display panel illustrated in FIG. 1. FIG. 3 is a circuit diagram illustrating pixel circuits and light-emitting elements illustrated in FIG. 2. The display panel 110 will hereinafter be described in further detail with reference to FIGS. 2 and 3 while avoiding any redundant descriptions thereof.

Referring to FIG. 2, the display panel 110 includes the display area where an image is displayed and the non-display area which surrounds the display area, and the display area includes the active area AA where an image is actually displayed and the dummy area DA which surrounds the active area AA.

In the active area AA, the scan lines $SL_1$ through $SL_n$ and the data lines $DL_1$ through $DL_m$ are arranged. The active pixels $PX_{11}$ through $PX_{nm}$ are arranged, in a matrix, at the intersections between the scan lines $SL_1$ through $SL_n$ and the data lines $DL_1$ through $DL_m$. The active pixels $PX_{11}$ through $PX_{nm}$ include a plurality of pixel circuits $C_{11}$ through $C_{nm}$, respectively, and a plurality of light-emitting elements $E_{11}$ through $E_{nm}$, respectively, and the light-emitting elements $E_{11}$ through $E_{nm}$ emit light by being supplied with a driving current from the pixel circuits $C_{11}$ through $C_{nm}$, respectively. The light-emitting elements $E_{11}$ through $E_{nm}$ can be detachably connected to the pixel circuits $C_{11}$ through $C_{nm}$, respectively.

Each of the pixel circuits $C_{11}$ through $C_{nm}$ can include one or more TFTs and a capacitor. Each of the active pixels $PX_{11}$ through $PX_{nm}$ can emit light of a single color, for example, light of an R color, a G color, a B color or a white color, but the described technology is not limited thereto. That is, the active pixels $PX_{11}$ through $PX_{nm}$ can emit light of various colors other than the R color, a G color, a B color and a white color. Each of the pixel circuits $C_{11}$ through $C_{nm}$ can be connected to one of the scan lines $SL_1$ through $SL_n$ in its corresponding row and to one of the data lines $DL_1$ through $DL_m$ in its corresponding column.

Each of the pixel circuits $C_{11}$ through $C_{nm}$ (for example, a pixel circuit $C_{ij}$ in an i-th row and a j-th column) can be detachably connected to an i-th scan line $SL_i$ and a j-th data line $DL_j$. For example, in the exemplary embodiment of FIGS. 1 to 3, in response to an active pixel $PX_{12}$, at the intersection between the first scan line $SL_1$ and the second data line $DL_2$, being a defective pixel, one or more lines between a pixel circuit $C_{12}$ and a light-emitting element $E_{12}$ of the defective pixel $PX_{12}$ can be disconnected during a repair process for the defective pixel $PX_{12}$, but the described technology is not limited thereto. That is, to disable the defective pixel $PX_{12}$, the pixel circuit $C_{12}$ can be disconnected from the first scan line $SL_1$, the second data line $DL_2$ or both.

In the exemplary embodiment of FIGS. 1 to 3, at least some of the lines between the pixel circuit $C_{12}$ and the light-emitting element $E_{12}$ (or an OLED) of the defective pixel $PX_{12}$ are disconnected and opened, i.e., a repair cut RC is formed in the defective pixel $PX_{12}$.

The repair lines $RL_1$ through $RL_n$, which extend substantially in parallel to, and are isolated from, the scan lines $SL_1$ through $SL_n$, respectively, are arranged along a row direction. Each of the light-emitting elements $E_{11}$ through $E_{nm}$, can be initially insulated from, and can be electrically connected, during a repair process, to, one of the repair lines $RL_1$ through $RL_n$ in its corresponding row. That is, each of the light-emitting elements $E_{11}$ through $E_{nm}$ can be connectably arranged with respect to one of the repair lines $RL_1$ through $RL_n$ in its corresponding row. For example, in the exemplary embodiment of FIGS. 1 to 3, in response to the active pixel $PX_{12}$ being a defective pixel, the light-emitting element $E_{12}$ is electrically connected to the first repair line $RL_1$, which is formed on a different layer than a repair short RS with an insulating layer interposed therebetween. For example, during a repair process, laser light is applied to the location of the repair short RS to destroy the insulating layer. As a result, a line connected to the anode of the light-emitting element $E_{12}$ and the repair line $RL_1$ can be short-circuited, and can thus be electrically connected. Therefore, the light-emitting element $E_{12}$ and the repair line $RL_1$ can be electrically connected.

The dummy area DA can be provided on at least one of the left and right sides of the active area AA. At least one dummy pixel can be arranged in each row of the dummy area DA. In the example illustrated in FIG. 3, the dummy area DA is formed on the left side of the active area AA, and one dummy pixel is arranged in each row of the dummy area DA.

In the dummy area DA, the dummy pixels $DPX_1$ through $DPX_n$, which are connected to the scan lines $SL_1$ through $SL_n$, respectively, are arranged. In the dummy area DA, the dummy data line DDL, which is connected to the dummy pixels $DPX_1$ through $DPX_n$, is also arranged. The dummy data line DDL extends in a column direction substantially in parallel to the data lines $DL_1$ through $DL_m$. The repair lines $RL_1$ through $RL_n$, and the scan lines $SL_1$ through $SL_n$ can extend even into the dummy area DA. That is, a dummy pixel $DPX_i$ in the i-th row can share the same scan line and the same repair line, i.e., the i-th scan line $SL_i$ and an i-th repair line $RL_i$, as active pixels $PX_{i1}$ through $PX_{im}$, in the i-th row.

For example, each of the dummy pixels $DPX_1$ through $DPX_n$ includes a dummy pixel circuit, but does not include any light-emitting element. However, the described technology is not limited to this example. That is, each of the dummy pixels $DPX_1$ through $DPX_n$ can include both a dummy pixel circuit and a light-emitting element, wherein the light-emitting element is necessarily activated by the corresponding dummy pixel. The dummy pixel circuits of the dummy pixels $DPX_1$ through $DPX_n$ can have the same circuitry as the pixel circuits $C_{11}$ through $C_{nm}$. The dummy pixel circuits of the dummy pixels $DPX_1$ through $DPX_n$ and the pixel circuits $C_{11}$ through $C_{nm}$ can be formed by the same photolithography process. Alternatively, the dummy pixel circuits of the dummy pixels $DPX_1$ through $DPX_n$ can have a different structure from the pixel circuits $C_{11}$ through $C_{nm}$. For example, each of the dummy pixel circuits of the dummy pixels $DPX_1$ through $DPX_n$ does not include some of the transistors and/or capacitors included in each of the pixel circuits $C_{11}$ through $C_{nm}$ and/or includes additional transistors and/or capacitors, or differs from the pixel circuits $C_{11}$ through $C_{nm}$ in terms of the sizes and properties of transistors and capacitors included therein. Each of the dummy pixel circuits of the dummy pixels $DPX_1$ through $DPX_n$ can include a plurality of driving transistors, which are suitable for light-emitting elements that emit light of different colors. The dummy pixel circuits of the dummy pixels $DPX_1$ through $DPX_n$ can be connected to the dummy data line DDL, and can be connected to the repair lines $RL_1$ through $RL_n$, respectively.

The switching elements SW can be connected via a plurality of pads "PAD" to the dummy data line DDL and to the data lines $DL_1$ through $DL_m$. The pads "PAD" can be arranged in the first direction, i.e., the direction of the scan lines $SL_1$ through $SL_n$, and can define a connecting area 220 for the data driving unit 120. The data driving unit 120 can be mounted on the connecting area 220 and can then be connected to the pads "PAD", or one terminal of a connecting cable connected to the data driving unit 120 can be connected to the pads "PAD".

The repair test line DC_Repair and the R, G and B test lines DC_R, DC_G and DC_B can be connected to the dummy data line DDL or the data lines $DL_1$ through $DL_m$ via the switching elements SW. During the early testing of the display panel 110, the display quality of the active pixels $PX_{11}$ through $PX_{nm}$ (particularly, those repaired with the dummy pixel circuits of the dummy pixels $DPX_1$ through $DPX_n$) can be tested by applying a direct-current (DC) or pulse voltage to the repair test line DC_Repair and the R, G and B test lines DC_R, DC_G and DC_B.

The switching elements SW can be disabled later through switching by a test gate voltage, thereby preventing the repair test line DC_Repair and the R, G and B test lines DC_R, DC_G and DC_B from serving as loads against a data voltage signal applied via each of the data lines $DL_1$ through $DL_m$ during a normal operation of the display device 10.

Referring to FIG. 3, each of the light-emitting elements $E_{11}$ through $E_{nm}$ is an OLED having a first electrode, a second electrode facing the first electrode and a light-emitting layer formed between the first and second electrodes. The first and second electrodes can be an anode electrode and a cathode electrode, respectively. Each of the pixel circuits $C_{11}$ through $C_{nm}$ can include two transistors, i.e., first and second transistors $T_1$ and $T_2$, and a capacitor $C_{st}$.

The first transistor $T_1$ can have a gate electrode connected to one of the scan lines $SL_1$ through $SL_n$ (for example, the i-th scan line $SL_i$), a first electrode connected to one of the data lines $DL_1$ through $DL_m$ (for example, an i-th data line $DL_i$), and a second electrode connected to the gate electrode of the second transistor $T_2$ and a first electrode of the capacitor $C_{st}$.

The second transistor $T_2$ can receive a first power supply voltage ELVDD from a first power source and can have a second electrode connected to a pixel electrode of a corresponding light-emitting element.

The capacitor $C_{st}$ can receive the first power supply voltage ELVDD from the first power source via a second electrode thereof.

The first transistor $T_1$ can transmit a j-th data signal Dj applied thereto via the j-th data line $DL_j$ to the first electrode of the capacitor $C_{st}$ whenever a scan signal is applied thereto via the i-th scan line $SL_i$. Accordingly, the capacitor $C_{st}$ is charged with a voltage corresponding to the j-th data signal Dj, and a driving current corresponding to the voltage that the capacitor $C_{st}$ is charged with is transmitted to the corresponding light-emitting element. As a result, the corresponding light-emitting element emits light.

The active pixels $PX_{11}$ through $PX_{nm}$ are illustrated in FIG. 3 as having a "2TR-1Cap" structure including two transistors and one capacitor, but the described technology is not limited thereto. That is, each of the active pixels $PX_{11}$ through $PX_{nm}$ can have various structures, other than that illustrated in FIG. 3, by including two or more TFTs and one or more capacitors, including additional lines other than those illustrated in FIG. 3, and/or not including some of the lines illustrated in FIG. 3.

The dummy pixels $DPX_1$ through $DPX_n$ can be arranged in the same rows as the active pixels $PX_{11}$ through $PX_{nm}$, and each of the dummy pixels $DPX_1$ through $DPX_n$ includes a dummy pixel circuit. The dummy pixel circuits of the dummy pixels $DPX_1$ through $DPX_n$ can be substantially the same as the pixel circuits $C_{11}$ through $C_{nm}$. Alternatively, the dummy pixel circuits of the dummy pixels $DPX_1$ through $DPX_n$ can differ from the pixel circuits $C_{11}$ through $C_{nm}$.

Each of the dummy pixel circuits of the dummy pixels $DPX_1$ through $DPX_n$ can include a first dummy transistor $DT_1$, which is connected to one of the scan lines $SL_1$ through $SL_n$ (for example, the i-th scan line $SL_i$) and the dummy data line DDL, a second dummy transistor $DT_2$ which is connected between the first power source voltage ELVDD and the first dummy transistor $DT_1$, and a dummy capacitor $DC_{st}$ which is connected between the first power supply voltage ELVDD and the first dummy transistor $DT_1$. The dummy pixel circuit illustrated in FIG. 3 is exemplary, and the described technology is not limited thereto. That is, each of the dummy pixel circuits of the dummy pixels $DPX_1$ through $DPX_n$ can have various structures other than that illustrated in FIG. 3 by including two or more TFTs and one or more capacitors or not including any capacitor.

The dummy data line DDL can be connected to a dummy wire DW. The dummy wire DW can be arranged to be connectable to one of a pair of adjacent data lines, for example, the i-th data line $DL_i$ and the j-th data line $DL_j$.

A defective pixel can be an active pixel with a defective pixel circuit. For example, in response to the active pixel $PX_{12}$ being a defective pixel, a repair cut RC is formed in the pixel circuit $C_{12}$ through laser cutting, and as a result, the light-emitting element $E_{12}$ can be disconnected from the pixel circuit $C_{12}$ due to the repair cut RC. Then, a repair short RS can be formed by using, for example, laser, and the light-emitting element $E_{12}$ of the defective pixel $PX_{12}$ can be connected to the first repair line $RL_1$ via the repair short RS. Accordingly, the light-emitting element $E_{12}$ of the defective pixel $PX_{12}$ can be connected to the dummy pixel circuit of the first dummy pixel $DPX_1$, i.e., a dummy pixel circuit $DC_1$.

The data driving unit 120 can apply the second data signal D2, which is applied to the second data line $DL_2$, to the dummy data line DDL as a dummy data signal DDS when the first scan signal S1 is applied to the first scan line $SL_1$, and as a result, the dummy pixel circuit $DC_1$ can provide a current corresponding to the data signal D2, which is applied to the defective pixel $PX_{12}$, to the light-emitting element $E_{12}$ (or the OLED) of the defective pixel $PX_{12}$ via the first repair line $RL_1$ and the repair short RS.

A method of performing visual inspection on the display panel 110, which has been subjected to a repair process, by applying a test voltage to the display panel 110 and the advantageous effects of the display device 10 will hereinafter be described.

FIG. 4 is a table for explaining an example of a method of identifying any bright and dark spots and locating any repaired pixels by applying the same test voltage to the repair test line DC_Repair and the G test line DC_G.

FIG. 5 is a table for explaining an example of a method of identifying the display quality of any repaired pixels and other normal pixels by applying the same test voltage to the repair test line DC_Repair and the G test line DC_G.

Referring to FIG. 4, a driving IC for driving the display panel 110, such as the data driving unit 120, is not installed yet at the stage of pre-visual inspection of the display panel 110. The R test line DC_R, can be connected to and apply a DC or pulse voltage corresponding to the R color to active pixels display the R color. The G test line DC_G, can be connected to and apply a DC or pulse voltage corresponding to the G color to active pixels display the G color. The B test line DC_B, can be connected to and apply a DC or pulse voltage corresponding to the B color to active pixels display the B color.

The dummy data line DDL, which is provided in the dummy area for the dummy pixels $DPX_1$ through $DPX_n$, can be connected to the repair test line DC_Repair and can thus receive an additional test voltage. However, if there is no repair test line DC_Repair provided, each of the dummy pixels $DPX_1$ through $DPX_n$ can be connected to, and receive a test voltage via, one of the R, G and B test lines DC_R, DC_G and DC_B.

In the exemplary embodiments of FIGS. 4 and 5, a G test voltage is applied as a repair test voltage, i.e., substantially the same test voltage is applied to the dummy data line DDL and the G test line DC_G.

Referring to FIG. 4, a white image is displayed on the display panel 110, and any dark spots displayed as dark spots is identified from the display panel 110. For example, an enable signal is applied to each of the R, G and B test lines DC_R, DC_G and DC_B, and the active pixels connected to each of the R, G and B test lines DC_R, DC_G and DC_B all emit light to display the white image. The same voltage as that applied to the G test line DC_G can be applied to the repair test line DC_Repair. In some embodiments, active pixels repaired with dummy pixels emit light normally and are not viewed as dark spots.

However, non-G repaired pixels, i.e., repaired B pixels or repaired R pixels, can be displayed slightly differently from repaired G pixels because B pixels and R pixels require a different voltage to be displayed at a given gray level, i.e., a different gamma level, from G pixels.

Thereafter, a black image can be displayed on the display panel 110, and any dark spots displayed as bright spots can be detected from the display panel 110. For example, an "off" voltage is applied to each of the repair test line DC_Repair and the R, G and B test lines DC_R, DC_G and DC_B. As a result, all the active pixels $PX_{11}$ through $PX_{nm}$ can be disabled, and a black image can be displayed. In this case, any defective pixels can be recognized as bright spots.

Thereafter, an additional voltage can be applied only to the repair test line DC_Repair, and the locations of the repaired pixels can be identified. The repaired pixels can be viewed as bright spots.

An inspector of the display panel 110 can identify the locations of the repaired pixels, and can reflect the identified locations of the repaired pixels in a later visual inspection of the display panel 110.

Referring to FIG. 5, after the inspection of the display panel 110 for any dark spots and bright spots, as illustrated in FIG. 4, an inspection of the display quality of the display panel 10 for R, G and B colors can be performed.

First, an R image can be displayed on the display panel 110, and an inspection of the quality of the display of the R image by the display device 10 can be performed.

To display the R image, an R image signal can be applied to the R test line DC_R, and the "off" voltage can be applied to each of the repair test line DC_Repair and the G and B test lines DC_G and DC_B.

Accordingly, repaired R pixels, repaired G pixels and repaired B pixels, which are connected to the dummy pixels connected to the repair test line DC_Repair, can emit no light in response to the receipt of the "off" voltage.

Therefore, the repaired R pixels can be detected in the R image as dark spots.

Similarly, the repaired B pixels can be detected in a B image as dark spots.

On the other hand, for an inspection of the quality of the display of a G image by the display panel 110, a G image signal can be applied to the G test line DC_G and the repair test line DC_Repair to display a G image, and as a result, G pixels and dummy pixels are enabled.

Accordingly, the repaired R pixels, the repaired G pixels and the repaired B pixels, which are connected to the dummy pixels connected to the repair test line DC_Repair, can all emit light, and the repaired R pixels and the repaired B pixels can be detected in the G image as bright spots.

The inspector can locate any repaired pixels from the display panel 110, as described above with reference to FIG. 4, can perform a display quality inspection on the display panel 110, as described above with reference to FIG. 5, and can thus determine repaired pixels that show different operating properties from other normal active pixels as not necessarily being defective.

FIG. 6 is a table for explaining an example of a method of identifying the display quality of repaired pixels and other normal pixels by applying the "off" voltage not only to the G test line DC_G, but also to the repair test line DC_Repair.

Referring to FIG. 6, the "off" voltage is applied to the repair test line DC_Repair to display R, G and B images.

In each of the R, G and B images, repaired pixels can continue to be off, and can be detected as dark spots.

The inspector can apply a voltage to the repair test line DC_Repair to identify the locations of repaired pixels in advance, as described above with reference to FIG. 4.

The inspector can determine, based on the identified locations of the repaired pixels, that repaired pixels displayed in each of the R, G and B images as dark spots are normal pixels.

In the example of FIG. 5, repaired pixels are detected as both bright spots and dark spots, and emit light of different colors. On the other hand, in the example of FIG. 6, repaired pixels are all detected as dark spots.

Accordingly, the inspector can easily determine whether pixels that emit light abnormally in R, G and B images are repaired pixels, and as a result, the precision and speed of the inspection can be improved.

Figure 7:
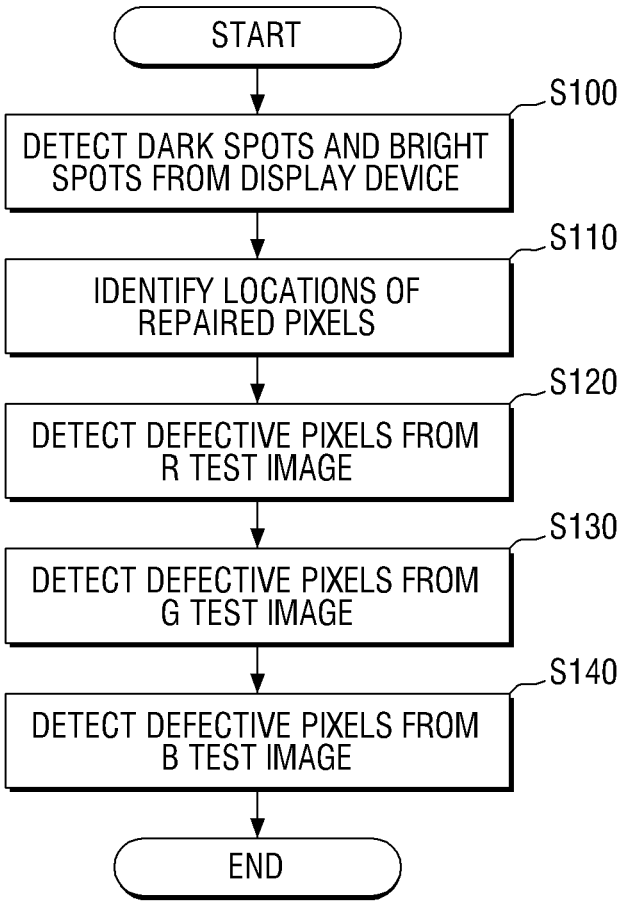
FIG. 7 is a flowchart illustrating a visual inspection process for the display device according to the exemplary embodiment of FIG. 1.

FIG. 7 is a flowchart illustrating a visual inspection process for the display device 10.

Referring to FIG. 7, dark spots and bright spots are detected from the display device 10 (S100), as described above with reference to FIG. 4.

Thereafter, the locations of repaired pixels in the display device 10 can be identified (S110), as described above with reference to FIG. 4.

Thereafter, defective pixels and the display quality of the display device 10 can be detected using an R test image (S120), as described above with reference to FIG. 5.

Thereafter, defective pixels and the display quality of the display device 10 can be detected using a G test image (S130), as described above with reference to FIG. 5.

Thereafter, defective pixels and the display quality of the display device 10 can be detected using a B test image (S140), as described above with reference to FIG. 5.

Since the repaired pixels in the display device 10 are already detected and identified, repaired pixels detected from each of R, G and B images as dark spots can be determined to be normal.

Figure 8:
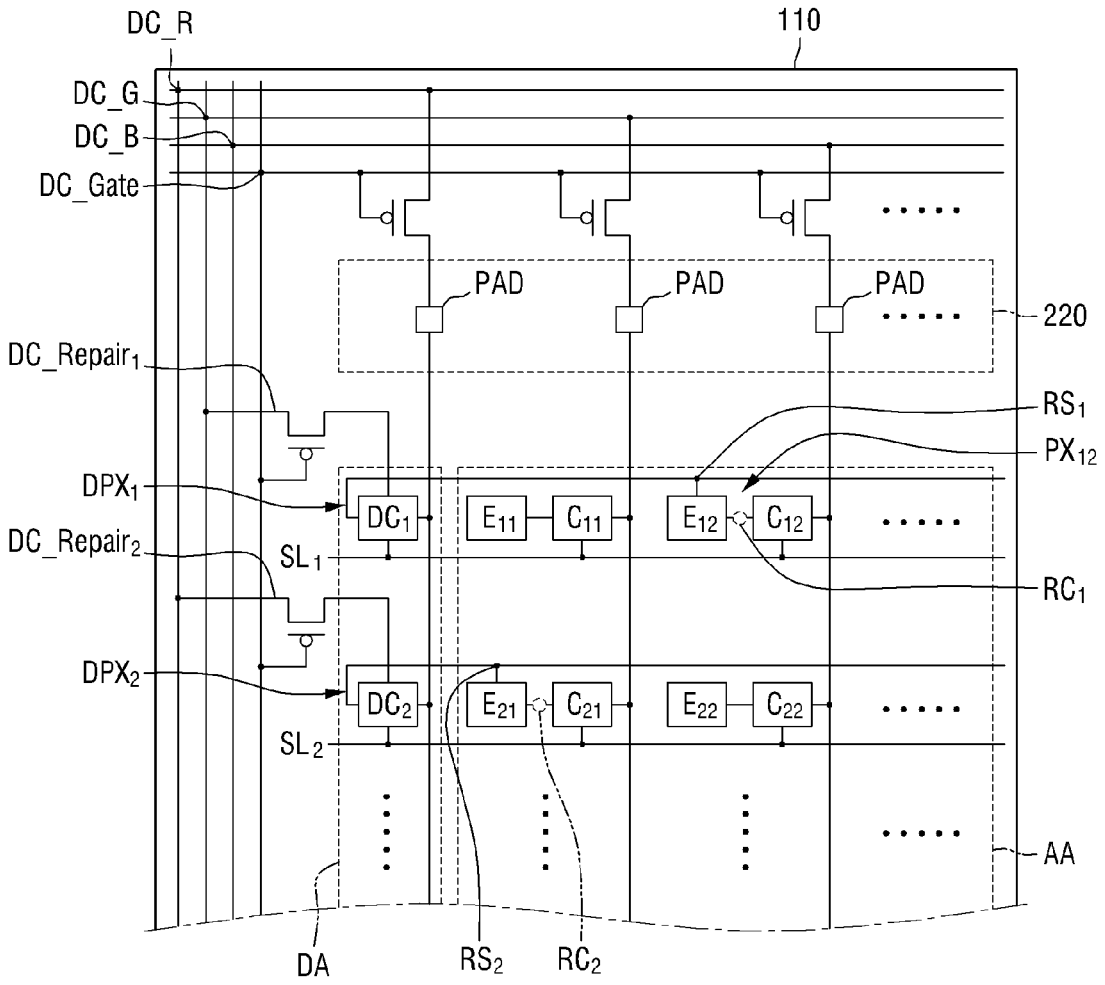
FIG. 8 is a schematic block diagram of a display device according to another exemplary embodiment.

FIG. 8 is a schematic block diagram of a display panel according to another exemplary embodiment.

In FIGS. 1 to 3 and 8, like reference numerals indicate like elements, and thus, detailed descriptions thereof will be omitted. The exemplary embodiment of FIG. 8 will hereinafter be described, focusing mainly on differences with the exemplary embodiment of FIGS. 1 to 3.

Referring to FIG. 8, a display panel 110 includes R, G and B test lines DC_R, DC_G and DC_B, which extend in both a first direction (i.e., a direction of a plurality of scan lines including first and second scan lines $SL_1$ through $SL_2$) and a second direction (i.e., a direction of a plurality of data lines including a first data line $DL_1$).

In an area where the R, G and B test lines DC_R, DC_G and DC_B extend in the second direction, at least one of a plurality of dummy pixels, including first and second dummy pixels $DPX_1$ and $DPX_2$, can be connected to one of the R, G and B test lines DC_R, DC_G and DC_B.

For example, in the exemplary embodiment of FIG. 8, in response to a pixel circuit $C_{12}$ of an active pixel $PX_{12}$, at the intersection between the first scan line $SL_1$ and the first data line, and a pixel circuit $C_{21}$ of an active pixel $PX_{21}$, at the intersection between the second scan line $SL_2$ and the first data line $DL_1$, both being defective, the first dummy pixel $DPX_1$ can be connected to a light-emitting element $E_{12}$ of the defective pixel $PX_{12}$ via a first repair line $RL_1$ and a first repair short $RS_1$. And the second dummy pixel $DPX_2$ can be connected to a light-emitting element $E_{21}$ of the defective pixel $PX_{21}$ via a second repair line $RL_2$ and a second repair short $RS_2$.

Also, the light-emitting element $E_{12}$ can be disconnected from the pixel circuit $C_{12}$ by a first repair cut $RC_1$, and the first dummy pixel $DPX_1$ can be connected to the G test line DC_G, which corresponds to the color of the light-emitting element $E_{12}$, via a switching element SW.

Similarly, the light-emitting element $E_{21}$ can be disconnected from the pixel circuit $C_{21}$ by a second repair cut $RC_2$, and the second dummy pixel $DPX_2$ can be connected to the R test line DC_R, which corresponds to the color of the light-emitting element $E_{21}$, via a switching element SW.

The display panel 110 is illustrated in FIG. 8 as having a plurality of active pixels that are arranged in the order of R, G and B.

FIG. 9 is a table for explaining an example of a method of identifying the display quality of repaired pixels and other normal pixels by displaying R, G and B images on the display device according to the exemplary embodiment of FIG. 8.

The example of FIG. 9 will hereinafter be described, focusing mainly on differences with the example of FIG. 5.

Referring to FIG. 9, in response to, for example, the active pixels $PX_{12}$ and $PX_{21}$, being repaired pixels, the first dummy pixel $DPX_1$ is connected to the G test line DC_G, and the second dummy pixel $DPX_2$ is connected to the R test line DC_R.

Then, when the display panel 110 displays an R image, a test signal $DC_Repair_1$, which is applied to the first dummy pixel $DPX_1$, can be switched to an "off" state, and a test signal $DC_Repair_2$, which is applied to the second dummy pixel $DPX_2$, can be switched to an "on" state. Accordingly, when the display panel 110 displays an R image, repaired R pixels emit light, and other repaired pixels are turned off. Accordingly, an R image with no dark spots can be displayed as long as there are no other defective pixels.

Similarly, when the display panel 110 displays a G or B image, the G or B image can be displayed with no dark spots as long as there are no other defective pixels.

Accordingly, it is possible to avoid the inconvenience of identifying the locations of repaired pixels in advance and reflecting the identified locations of the repaired pixels in a later visual inspection.

While the inventive technology has been described with reference to the figures, it will be understood by those of ordinary skill in the art that various changes in form and details can be made therein without departing from the spirit and scope as defined by the following claims.

What is claimed is:

1. A display device, comprising:

a display panel including a display area configured to display an image and a non-display area surrounding the display area;

a plurality of active pixels formed in the display area extending in first and second directions crossing each other as a matrix;

a plurality of dummy pixels formed in the non-display area and extending in the second direction;

a repair test line formed in the non-display area and extending in the first direction, wherein the repair test line is directly connected to the dummy pixels and not the active pixels;

one or more active pixel test lines formed in the non-display area and extending in the first direction, wherein the active pixel test lines are electrically connected to the active pixels;

a plurality of scan lines electrically connected to the active pixels and the dummy pixels and extending in the first direction;

a plurality of data lines electrically connected to the active pixels and extending in the second direction;

at least one dummy data line electrically connected to the dummy pixels and extending in the second direction;

a plurality of repair lines electrically connected to the dummy pixels and extending in the first direction, wherein at least one of the dummy pixels is electrically connected to at least one of the active pixels via at least one of the repair lines; and a plurality of switches including a plurality of first switches configured to electrically connect the dummy data line to the repair test line and a plurality of second switches configured to electrically connect each of the data lines to one of the active pixel test lines.

2. The display device of claim 1, further comprising a test gate line formed in the non-display area and extending in the first direction, wherein the test gate line is electrically connected to the first and second switches, and wherein the first and second switches are configured to switch on or off based on a voltage signal applied to the test gate line.

3. The display device of claim 2, wherein the first and second switches include P-channel metal oxide semiconductor (PMOS) transistors, and wherein each of the first and second switches includes a gate terminal electrically connected to the test gate line, a drain terminal electrically connected to the dummy data line or one of the data lines, and a source terminal electrically connected to the repair test line or one of the active pixel test lines.

4. The display device of claim 1, wherein the active pixel test lines include red (R), green (G) and blue (13) test lines.

5. The display device of claim 1, wherein each of the active pixels includes a pixel circuit electrically connected to one of the data lines and a light-emitting circuit configured to receive a driving current from the pixel circuit, and wherein the pixel circuit and the light-emitting circuit are electrically connected via a selectively cuttable line.

6. The display device of claim 5, wherein at least one of the active pixels includes i) at least one first repair portion configured to be cut so as to block a driving current applied from the pixel circuit to the light-emitting circuit and ii) at least one second repair portion configured to short the light-emitting circuit and the repair line and configured to transfer a driving current to the light-emitting circuit from the at least one of dummy pixels.

7. The display device of claim 6, further comprising a data driver configured to i) respectively transmit a plurality of data signals to the data lines, ii) transmit a dummy data signal to the dummy data line, and iii) transmit at least one data signal to the at least one dummy pixel as the dummy data signal.

8. The display device of claim 1, further comprising a plurality of pads configured to electrically connect the dummy data line to the first switches and electrically connect the data lines to the second switches.

9. The display device of claim 8, further comprising a data driver configured to respectively drive a plurality of data signals to the data lines, and drive a dummy data signal to the dummy data line, wherein the data driver is electrically connected to the dummy data line and the data lines via the pads.

10. The display device of claim 9, wherein the data driver is further configured to drive at least one data signal to the at least one dummy pixel as the dummy data signal.

11. A display device, comprising:

a display panel including a display area configured to display an image and a non-display area surrounding the display area;

a plurality of active pixels formed in the display area extending in first and second directions crossing each other as a matrix;

a plurality of dummy pixels formed in the non-display area and extending in the second direction;

a plurality of active pixel test lines formed in the non-display area and extending in the first and second directions, wherein the active pixel test lines extend in the first direction across a row of the active pixels and the second direction across a column of the dummy pixels;

a plurality of scan lines electrically connected to the active pixels and extending in the first direction;

a plurality of data lines electrically connected to the active pixels and extending in the second direction;

at least one dummy data line electrically connected to the dummy pixels and extending in the second direction;

a plurality of repair lines electrically connected to the dummy pixels and extending in the first direction, wherein at least one of the dummy pixels is electrically connected to at least one of the active pixels via at least one of the repair lines;

a repair test line directly connected to the dummy pixels and not the active pixels; and a plurality of switches including a plurality of first switches configured to electrically connect at least one of the dummy pixels to one of the active pixel test lines and a plurality of second switches configured to electrically connect each of the data lines to one of the active pixel test lines.

12. The display device of claim 11, further comprising a test gate line formed in the non-display area and extending in the first and second directions, wherein the test gate line is electrically connected to the first and second switches, and wherein the first and second switches are configured to switch on or off based on a voltage signal applied to the test gate line.

13. The display device of claim 12, wherein the first and second switches include PMOS transistors, and wherein each of the first and second switches includes a gate terminal electrically connected to the test gate line, a drain terminal electrically connected to the dummy data line or one of the data lines, and a source terminal electrically connected to the repair test line or one of the active pixel test lines.

14. The display device of claim 11, wherein the active pixel test lines include R, G and B test lines.

15. The display device of claim 11, wherein each of the active pixels includes a pixel circuit electrically connected to one of the data lines and a light-emitting circuit configured to receive a driving current from the pixel circuit, and wherein the pixel circuit and the light-emitting circuit are electrically connected via a selectively cuttable line.

16. The display device of claim 15, wherein at least one of the active pixels includes i) at least one first repair portion configured to be cut so as to block a driving current applied from the pixel circuit to the light-emitting circuit and ii) at least one second repair portion configured to short the light-emitting circuit and the repair line and configured to transfer a driving current to the light-emitting circuit from the at least one of dummy pixels.

17. The display device of claim 16, further comprising a data driver configured to i) respectively transmit a plurality of data signals to the data lines, ii) transmit a dummy data signal to the dummy data line, and iii) transmit at least one data signal to the at least one dummy pixel as the dummy data signal.

18. The display device of claim 11, further comprising a plurality of pads configured to electrically connect the dummy data line to the first switches and electrically connect the data lines to the second switches.

19. The display device of claim 18, further comprising a data driver configured to respectively drive a plurality of data signals to the data lines, and drive a dummy data signal to the dummy data line, wherein the data driver is electrically connected to the dummy data line and the data lines via the pads.

20. The display device of claim 19, wherein the data driver is further configured to drive at least one data signal to the at least one dummy pixel as the dummy data signal.

* * * * *